US006260538B1

(12) United States Patent
Soteriou

(10) Patent No.: US 6,260,538 B1
(45) Date of Patent: Jul. 17, 2001

(54) FUEL SYSTEM

(75) Inventor: Cecilia Catherine Elizabeth Soteriou, Lyndhurst (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/435,250

(22) Filed: Nov. 5, 1999

(30) Foreign Application Priority Data

Nov. 7, 1998 (GB) ..... 9824366

(51) Int. Cl.[7] ..... F02M 41/00
(52) U.S. Cl. ..... 123/456; 123/447
(58) Field of Search ..... 123/456, 447, 123/468, 510, 497, 463

(56) References Cited

U.S. PATENT DOCUMENTS 4,132,205 * 1/1979 Merritt ..... 123/139
5,109,822 * 5/1992 Martin ..... 123/456
5,592,968 * 1/1997 Nakashima et al. ..... 123/561
5,752,486 * 5/1998 Nakashima et al. ..... 123/467
6,095,119 * 8/2000 Maier et al. ..... 123/447
6,186,119 * 2/2001 Ciecko ..... 123/456

* cited by examiner

*Primary Examiner*—Henry C. Yuen
*Assistant Examiner*—Mahmoud M Gimie
(74) *Attorney, Agent, or Firm*—Wells, St. John, Roberts, Gregory & Matkin, P.S.

(57) ABSTRACT

A fuel system comprising a fuel pump having a pump outlet which communicates with a fuel volume, the volume communicating with the inlets of a plurality of fuel injectors. The fuel flow paths between the pump outlet and the inlet of each injector form substantially equal restrictions to the flow of fuel.

15 Claims, 1 Drawing Sheet

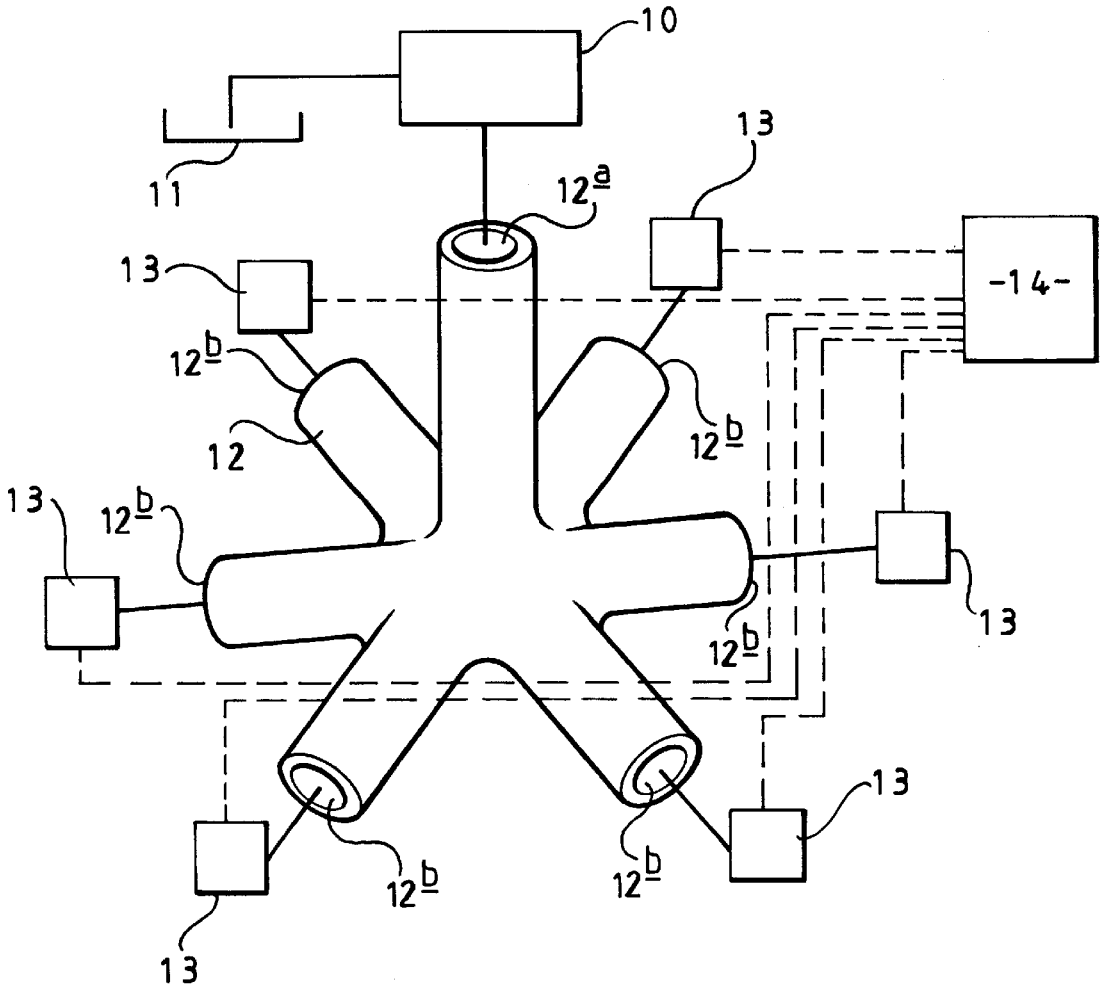
10
11
12a
13
13
-14-
12b
12
12b
13
12b
13
12b
13
12b
12b
13

FUEL SYSTEM

BACKGROUND OF THE INVENTION

A fuel system typically comprises a fuel pump arranged to charge a volume, accumulator or common rail to an appropriate fuel pressure, and a plurality of individually actuable fuel injectors arranged to receive fuel under high pressure from the volume, accumulator or common rail. It has been found that, due to the hydraulics of the system, the fuel pressures applied to the various injectors may differ from one another, and the injection of fuel through one injector or the discharge of the fuel pump into the system may have a detrimental effect upon subsequent injections of fuel through others of the injectors due to the transmission of pressure waves from one injector to another. It is an object of the invention to provide a fuel system in which these effects are reduced.

SUMMARY OF THE INVENTION

According to the present invention there is provided a fuel system comprising a fuel pump having an outlet which communicates with a fuel volume, the volume communicating with the inlets of a plurality of fuel injectors, wherein the fuel flow paths between the pump outlet and the inlet of each injector form substantially equal restrictions to the flow of fuel.

Such an arrangement is advantageous in that each injector will have applied thereto, in use, substantially the same fuel pressure, and as a result injector to injector variations can be reduced. Further, pressure waves within the fuel system will be incident upon all of the injectors at substantially the same synchronised times, thus variations between the operation of the injectors are further reduced.

It will be appreciated that the restriction to flow formed by each flow path is dependent upon a number of factors, for example the path length and diameter, the number of bends in the flow path and the tightness of such bends.

The fuel volume conveniently comprises a common rail which includes an inlet for connection to the pump outlet and a plurality of outlets for connection to respective injectors.

The inlet and/or the outlets may be provided with regions of reduced diameter. Such an arrangement is advantageous in that the transmission of pressure waves within the fuel system can be damped, and as a result injection to injection variations can be reduced.

The invention will further be described, by way of example, with reference to the accompanying drawing which illustrates a fuel system in accordance with an embodiment of the invention.

BRIEF DESCRIPTION OF THE DRAWINGS

FIGURE illustrates a fuel system in accordance with an embodiment of the invention.

DETAILED DESCRIPTION OF THE EMBODIMENT

The fuel system illustrated in the accompanying drawing comprises a fuel pump 10 arranged to receive fuel from a fuel reservoir 11, and to charge a common rail 12 with fuel to an appropriately high pressure. The common rail 12 is connected to six individually actuable fuel injectors 13 which are operable under the control of an appropriate control system 14.

The arrangement illustrated in FIG. 1 is shown in diagrammatic form, and so it is not particularly clear in FIG. 1, but, in accordance with the present invention, the fuel pump 10 includes a pump outlet which is coupled directly to an inlet 12*a* of the common rail 12. The common rail 12 further includes six outlets 12*b* which are coupled directly to the inlets of the injectors 13. The common rail 12 is designed such that the fuel flow paths from the inlet 12*a,* and hence the outlet of the pump, to each of the outlets 12*b,* and hence the inlets of the injectors 13, are of equal length and diameter, and that other factors which affect the restriction to fuel flow are also equal. As a result, any pressure drops between the inlet 12*a* and the respective outlets 12*b* will be equal. It will be appreciated, therefore, that each injector 13 is subject to fuel at substantially the same fuel pressure, thus injection differences between the injectors will be reduced. Further, any pressure waves transmitted within the fuel system which, in a conventional common rail fuel system, may give rise to injector to injector variations will be incident upon all of the injectors 13 at substantially the same synchronised instances, and so the risk of variations between injections of fuel by the various injectors 13 will be reduced.

Each outlet 12*b* is conveniently provided with an orifice or flow restriction of smaller diameter than the internal diameter of the remainder of that part of the common rail 12. As a result, pressure waves within the system are damped, thus reducing injection variations between separate injections. Similarly, the inlet 12*a* may be provided with an orifice or flow restriction to assist in damping of pressure waves within the system. The provision of the orifice or flow restriction in the inlet 12*a* may be in addition to or as an alternative to providing orifices or restrictions in the outlets 12*b*. It will be appreciated that the provision of such orifices or restriction in the outlets and/or inlet is optional.

Although in the description hereinbefore, six injectors 13 are provided, the fuel system being intended for use with a six cylinder compression ignition internal combustion engine, it will be appreciated that the invention is applicable to fuel systems for use in supplying fuel to engines having greater or fewer cylinders. Further, although the common rail 12 illustrated in the accompanying drawing comprises a plurality of pipes which are connected to one another, if desired the common rail 12 may further include an enlarged region defining an accumulator, and the accumulator may be of any suitable shape, for example cylindrical or cuboid.

In the accompanying drawing, the common rail is illustrated as comprising a single component. It will be appreciated that, provided the requirement that the path lengths and other factors giving rise to fuel flow restrictions to each injector are equal, the common rail may be of any suitable form, and may be composed of several components which are secured to one another. For example, the common rail may comprise an accumulator module or several accumulator modules to which appropriate high pressure pipes are secured to permit connection of the pump and the injectors to the accumulator module(s).

What is claimed is:

1. A fuel system comprising a fuel pump having a pump outlet for delivering fuel to a fuel volume, said volume comprising a hub in communication with a plurality of radially extending fuel flow paths, each one of the fuel flow paths providing communication between the hub and an inlet of a respective fuel injector, wherein each of the fuel flow paths between said pump outlet and said inlet of each injector presents a substantially equal restriction to the flow of fuel between the hub and the respective injector inlet, thereby to ensure pressure waves within the fuel system are incident upon the injector inlets at substantially synchronized times.

2. The fuel system as claimed in claim 1, wherein said fuel flow paths between said hub and said inlet of each injector have a diameter and a length, wherein said lengths and said diameters of said fuel flow paths are substantially equal.

3. The fuel system as claimed in claim 1, wherein said fuel volume comprises a common rail having an inlet for connection to said pump outlet and a plurality of outlets for connection to respective injectors.

4. The fuel system as claimed in claim 3, wherein said inlet of said common rail is provided with a region of reduced diameter.

5. The fuel system as claimed in claim 3, wherein each of said outlets is provided with a region of reduced diameter.

6. The fuel system as claimed in claim 3, wherein said common rail comprises a plurality of pipes in connection with one another.

7. The fuel system as claimed in claim 3, wherein said common rail comprises an enlarged region defining an accumulator.

8. The fuel system as claimed in claim 3, wherein said common rail comprises one or more accumulator module.

9. The fuel system as claimed in claim 1, wherein said fuel volume comprises an inlet for connection to said pump outlet and a plurality of outlets for connection to respective injectors.

10. The fuel system as claimed in claim 9, wherein said fuel volume comprises a common rail having an inlet for connection to said pump outlet and a plurality of outlets for connection to respective injectors.

11. The fuel system as claimed in claim 10, wherein said inlet of said common rail is provided with a region of reduced diameter.

12. The fuel system as claimed in claim 10, wherein each of said outlets is provided with a region of reduced diameter.

13. The fuel system as claimed in claim 10, wherein said common rail comprises a plurality of pipes in connection with one another, each one of said pipes defining one of said fuel flow paths.

14. The fuel system as claimed in claim 10, wherein said common rail comprises an enlarged region defining an accumulator.

15. The fuel system as claimed in claim 10, wherein said common rail comprises one or more accumulator module.

* * * * *